United States Patent [19]

Horton

[11] 4,393,361

[45] Jul. 12, 1983

[54] VARIABLE MAGNETICALLY BIASED LINEARITY CONTROL

[75] Inventor: Stanley K. Horton, McHenry, Ill.

[73] Assignee: Prem Magnetics, Inc., McHenry, Ill.

[21] Appl. No.: 304,817

[22] Filed: Sep. 23, 1981

[51] Int. Cl.[3] ..... H01F 1/00

[52] U.S. Cl. ..... 335/212; 335/210

[58] Field of Search ..... 335/210, 213, 212, 306; 313/421, 427, 428, 429, 430, 431

[56] References Cited

U.S. PATENT DOCUMENTS

| | | | |
|---|---|---|---|
| 3,781,731 | 12/1973 | Poel | 335/212 |
| 3,806,853 | 4/1974 | Kikuchi | 335/210 |
| 3,889,217 | 6/1975 | Martin et al. | 335/212 |
| 3,906,418 | 9/1975 | Doshi et al. | 335/212 |
| 4,331,907 | 5/1982 | Laux et al. | 335/213 |

FOREIGN PATENT DOCUMENTS

| | | | |
|---|---|---|---|
| 2951313 | 7/1981 | Fed. Rep. of Germany | 335/212 |

*Primary Examiner*—George Harris

*Attorney, Agent, or Firm*—Leo J. Aubel; Robert E. Browne

[57] ABSTRACT

A variable magnetically biased coil assembly for providing a linear display on the screen of a cathode ray tube.

5 Claims, 4 Drawing Figures

VARIABLE MAGNETICALLY BIASED LINEARITY CONTROL

BACKGROUND OF THE INVENTION

Typical cathode ray tubes include a source of electron beams which scan a face plate or screen. As is known, if the scan lines traverse the screen at constant speed, the display on the screen will not be linear. This is due to the fact that, as the electron beam from the electron gum scans the screen, it is functioning in an arc of a circle; and the screen is generally not formed in the same arc as the swing of the electron beam but, rather, the screen tends to be more planar in shape. Hence, the electron beam will be traveling for a shorter distance across the face at the center of the screen as compared to the distance that the beam travels across the face at either edge of the screen. Accordingly, adjustment of the rate of speed of the beam as it moves across the screen must be made in order to obtain linearity of display.

As will be explained hereinbelow, the present invention is directed to the provision of a variable magnetically biased linearity control for compensating for the foregoing variations to thereby provide a more linear display.

The linearity of display is of interest with respect to television picture tubes. However, the linearity of the display becomes critical in other more demanding applications, such as for computer terminals and word-processing terminals, wherein alpha-numeric displays including, for example, typewritten pages, are displayed on the screen. If the display is non-linear, the digits or type on one portion of the screen may be smaller than the digits or type on another portion of the screen and difficult to read which is, of course, undesirable.

The prior art discloses tuning coils having a dynamic adjustment, connected electrically in series with the deflection yoke of a cathode ray tube. The present invention discloses an improvement over the prior art in providing a tuning coil which is of a simplified construction and which is conventionally and readily adjustable.

SUMMARY OF INVENTION

The present invention discloses a variable magnetically biased linearity coil, wound on a core of I-shaped construction. A pair of stationary magnets is mounted on opposite ends of the core; and a rotatable magnet is mounted contiguous to the first magnet to provide a magnetic field which is adjustably combined with the magnetic field of the permanent magnet to thereby control the permeability of the core and, hence, the induction of the coil and the current flow therethrough in a preselected manner.

The foregoing features and advantages of the present invention will be apparent from the following more particular description of the invention. The accompanying drawings, listed hereinbelow, are useful in explaining the invention wherein:

DESCRIPTION OF THE INVENTION

Figure 1:
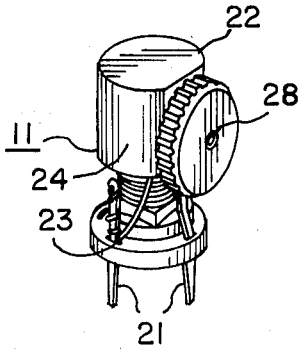
FIG. 1 is an isometric view of an adjustable tuning coil, in accordance with the invention.
Figure 2:
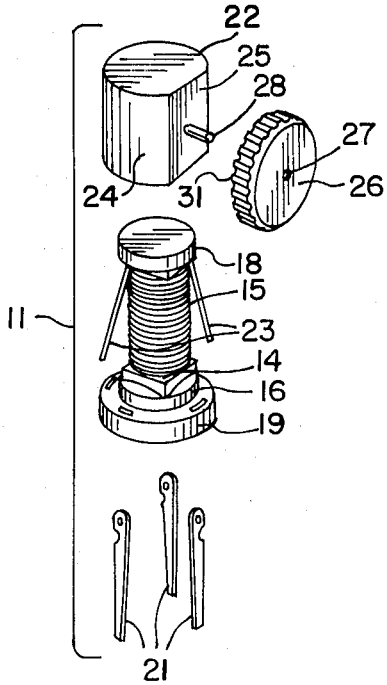
FIG. 2 is an exploded view of the structure of FIG. 1.

FIG. 1 shows an isometric view of one embodiment of the inventive variable magnetically biased linearity coil 11, substantially in actual size. The coil 11 is structurally ready for mounting on an associated electronic circuitry. FIG. 2 shows an exploded view of the coil assembly of FIG. 1 to more clearly show the structural details of the components of the inventive assembly.

The coil assembly 11 includes an elongated I-shaped core 14, which is rectangular in cross-section. A wire coil 15 is wounded on the core 14. A first magnet 16, which may be of circular configuration, is stationarily mounted, such as by adhesive, at the lower end of the core 14; and a second similar magnet 18 is likewise mounted on the top or opposite end of core 14. The magnet 16 is, in turn, mounted as by an epoxy adhesive on a circular plastic base 19. Terminal pins 21 extend through, and are affixed to, base 19. Two of the terminal pins 21 are connected, as by soldering or wire winding, to leads 23, which comprise the ends of coil 15. The terminal pins 21 provide the electrical connections for the coil assembly to the associated electronic circuitry (not shown). The base 19 and the terminal pins 21 extending therethrough provide a means for securely mounting the coil assembly 11 to the associated printed circuit board or electronic chassis.

An inverted cup-shaped cover 22 is mounted on magnet 18. The walls 24 or sides of the cover 22 extend downwardly around the magnet 18 and a portion of the core 14 and coil 15. In top plan view, the cover is generally circular in shape, with a flatted side to provide a flat frontal wall or surface 25. A permanent magnet 26 of circular configuration is mounted on surface 25. More particularly, magnet 26 has a central hole 27 formed therein; an eyelet-type fastener 28 extends through the hole 27 of magnet 26, and the fastener 28 is affixed to the wall 25 of cover 22. The fastener 28 functions as a shaft about which magnet 26 may be adjustably rotated. Note that fastener 28 holds the surface of magnet 26 in relatively tight frictional contact against the flat surface of wall 25 to thereby retain the magnet 26 in the position to which it has been rotated.

Magnet 26 is magnetized only on its surface 31 adjacent the core 14 and magnet 18; that is, a portion of the surface 31 is of a North-Pole polarization and a diametrically opposed portion of the surface is of a South-Pole polarization. In one embodiment, the magnets 16 and 18 are of substantially equal magnetic strength; and magnet 26 is of a slightly greater magnetic strength than magnets 16 and 18.

Figure 4:
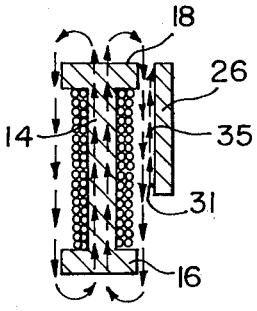
FIGS. 3 and 4 are sketches, useful in explaining the structure of the invention.
Figure 3:
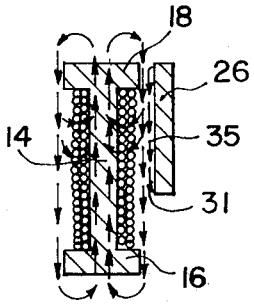

The operation of the coil assembly 11 may be described with reference to FIGS. 3 and 4, as well as to FIGS. 1 and 2. FIG. 3 is a sketch, showing that the magnets 16 and 18 are oriented to be in aiding relation such that the magnetic lines of flux extend from the magnets 16 and 18 through core 14, as indicated. In FIG. 3, magnet 26 is oriented such that its magnetic lines of flux 35, provided by magnet 26, are in an aiding relation with respect to the magnetic lines of flux producted by magnets 16 and 18; and, accordingly, the field strength in the core 14 is at a maximum value. FIG. 4 shows a sketch wherein the magnet 26 is rotated 180° with respect to the position shown in FIG. 3. In the case shown in FIG. 4, the magnet 26 is oriented such that its magnetic lines of flux 35 are in bucking relation with the lines of flux produced by magnets 16 and 18. Accordingly, the field strength in the core 14 is at a minimum value. Rotatable adjustment of the magnet 26 over an angle of 180° smoothly and selectively varies the field strength in core 14 in an analog manner from a maximum to a minimum value. As is known, because of the foregoing variations, the effective inductance of the assembly 11 varies in substantially a horizontal "S" shape to thereby adjust the speed of the beam scan to compensate for the shorter travel across the center of the screen. Thus, as stated above, the inventive assembly provides an improved linear display on the screen of the associated cathode ray tube.

While the invention has been particularly shown and described with reference to a preferred embodiment thereof, it will be understood by those skilled in the art that various changes in form and details may be made therein without departing from the spirit and scope of the invention.

I claim:

1. A variable magnetically biased linearity coil assembly for use such as with a cathode ray tube display device, comprising, in combination, an essentially I-shaped core, a coil wound on said core, a first permanent magnet stationarily mounted adjacent one end of said I-shaped core, a second permanent magnet mounted adjacent the opposite end of said core, said first and second magnets providing a magnetic field having flux lines extending through said core, a non-magnetizable support mounted adjacent said one end of said core, a cylindrically shaped element having a magnetized substantially flat surface thereon mounted on said support in spaced relation to said core and said magnets with said magnetized flat surface facing said core and said magnet, a mounting shaft extending outwardly from said support in a direction transverse to the axis of said I-shaped core for mounting said element in rotatable relation to said core and said magnets, and rotatable adjustment of said element selectively adjusting the magnetic strength of said second magnet to thereby provide an adjustable linearity coil.

2. An apparatus as in claim 1, wherein said first and second magnets are mounted on respective ends of said core and said support forms a cap having downwardly extending walls.

3. An apparatus as in claim 1, wherein the support is generally circular, with one flatted side, in top view and has a flat surface on which said magnet may be mounted in frictional rotatable engagement.

4. An apparatus as in claim 1, wherein said surface of said cylindrical magnet is polarized to have one North Pole and one South Pole.

5. An apparatus as in claim 1, further including a base, said second magnet mounted on said base, terminal pins mounted on said base and extending therethrough, two of said pins being connected with said coil for providing electrical connection means to associated electronic circuitry.

* * * * *